US005251518A

United States Patent [19]

Woo

[11] Patent Number: 5,251,518

[45] Date of Patent: Oct. 12, 1993

[54] PIPE WRENCH

[76] Inventor: Young S. Woo, 279-133 Sangdo-dong, Dongjak-gu, Seoul, Rep. of Korea

[21] Appl. No.: 925,203

[22] Filed: Aug. 6, 1992

[30] Foreign Application Priority Data

Aug. 26, 1991 [KR] Rep. of Korea ..... 13653/1991
Dec. 19, 1991 [KR] Rep. of Korea ..... 22789/1991
Mar. 16, 1992 [KR] Rep. of Korea ..... 4185/1992

[51] Int. Cl.[5] ..... B25B 13/28
[52] U.S. Cl. ..... 81/99; 81/58
[58] Field of Search ..... 81/92-99, 81/111, 58, 60, DIG. 6

[56] References Cited

U.S. PATENT DOCUMENTS 65,465 6/1867 Barnes ..... 81/99
189,567 4/1877 Mathews ..... 81/99
470,042 3/1892 George ..... 81/99
720,385 2/1903 Storle ..... 81/99
1,333,174 3/1920 Henry ..... 81/99
1,576,918 3/1926 Lidell ..... 81/99
4,773,287 9/1988 Clarke ..... 81/97 X

*Primary Examiner*—D. S. Meislin
*Attorney, Agent, or Firm*—Finnegan, Henderson, Farabow, Garrett & Dunner

[57] ABSTRACT

A pipe wrench capable of turning pipes or rods in a convenient manner is disclosed. The wrench includes a handle portion and a pivotable portion, and these two portions are connected through a hinge portion. The pivotable portion pivotally closes and opens the mouth of the pipe wrench, and a pipe to be turned is secured to a rectangular corner of the pivotable portion, so that pipes and rods can be turned in a convenient manner.

1 Claim, 8 Drawing Sheets

PIPE WRENCH

FIELD OF THE INVENTION

The present invention relates to a pipe wrench which is capable of turning a pipe by grasping the pipe in an easy manner regardless of the magnitude of the outside diameter of the pipe or rod, when connecting or fastening pipes or rods having fastening portions formed on the tips thereof.

Background of the Invention

Conventionally, when securing a pipe wrench to a pipe or rod, a screw which is capable of adjusting the size of the mouth of the pipe wrench is turned so that the mouth of the wrench is opened large enough to receive the pipe or rod. The pipe or rod is inserted into the mouth of the wrench, and then, the mouth of the pipe wrench is tightened to the pipe or rod by turning the screw in the reverse direction. Then the pipe wrench is turned by grasping the tip portion of the wrench in order to rotate the pipe or rod, and, when rotating the pipe or rod repeatedly, the mouth adjusting screw has to be repeatedly turned forwardly and reversely. Further, in this process, the mouth of the pipe wrench can slip relative to the pipe or rod, thereby extending the working time and delaying all related activities.

Summary of the Invention

The present invention is intended to overcome the above described disadvantages of the conventional technique.

Therefore it is an object of the present invention to provide a pipe wrench which is constituted in a pivotally closable/openable form, so that, once a pipe or rod is inserted into the mouth of the pipe wrench, the pipe or rod is firmly secured regardless of the outside diameter of the pipe or rod, thereby making it possible to perform the required task in a convenient and efficient manner.

It is another object of the present invention to provide a pipe wrench in which the structure is simple, and the total bulk is compact.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
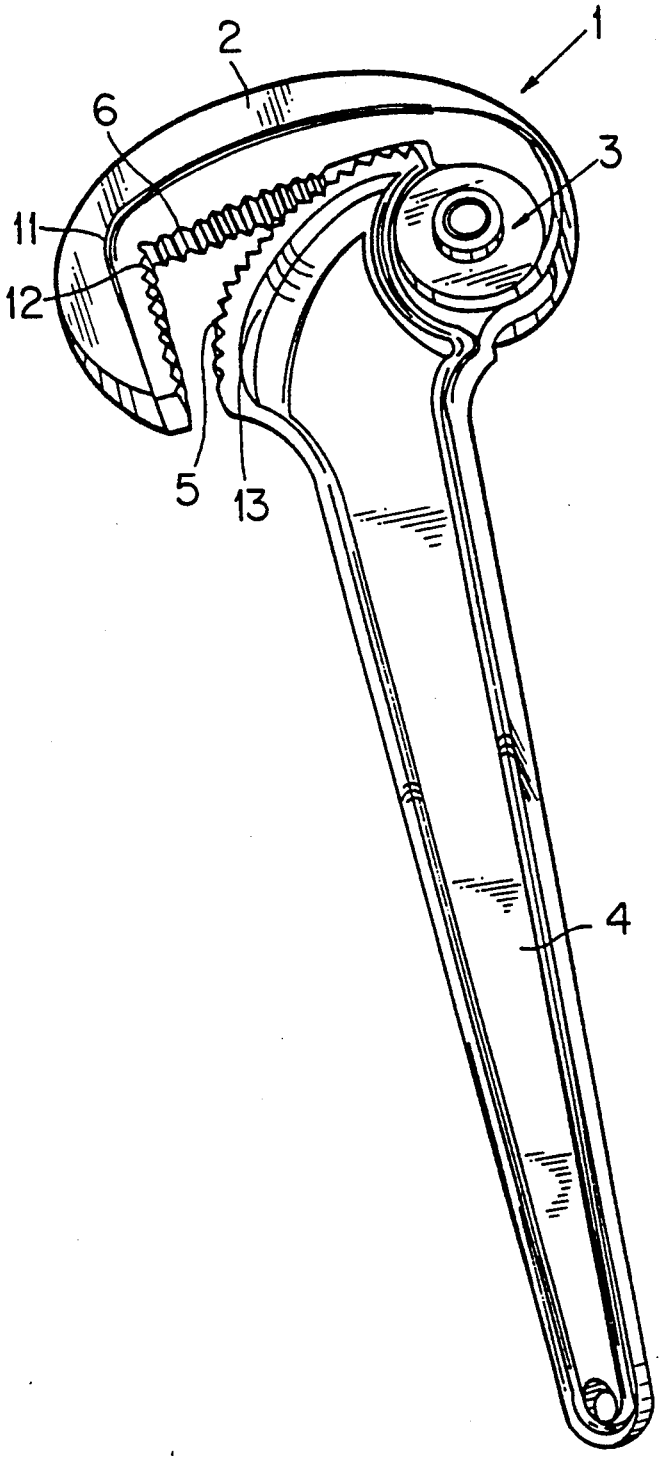
FIG. 1 is a perspective view of the pipe wrench according to the present invention.
Figure 2:
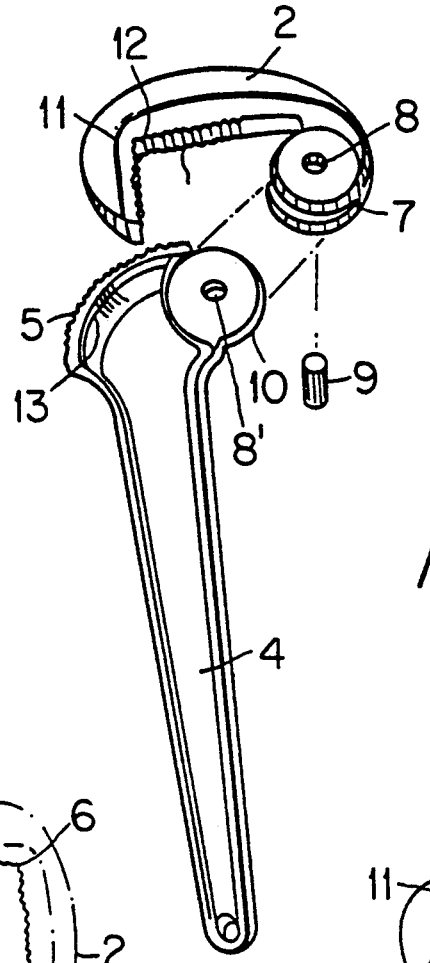
FIG. 2 is an exploded perspective view of the pipe wrench according to the present invention.
Figure 3:
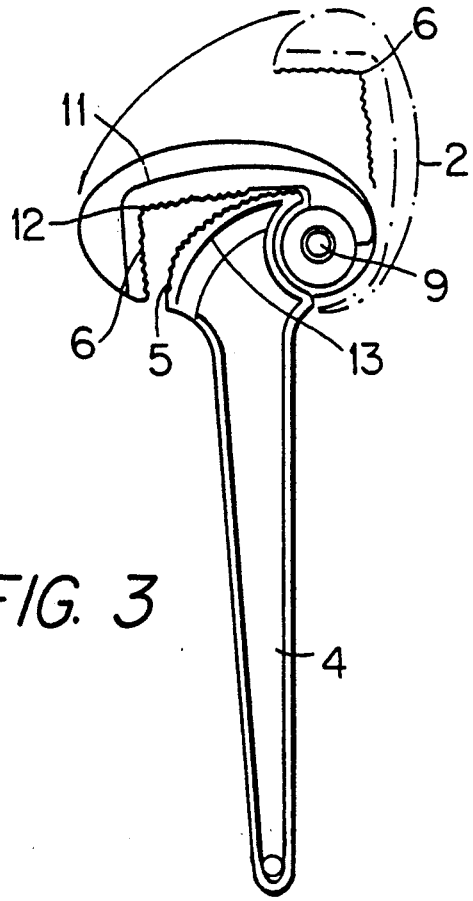
FIG. 3 illustrates the actuation of the pipe wrench according to the present invention.
Figure 4:
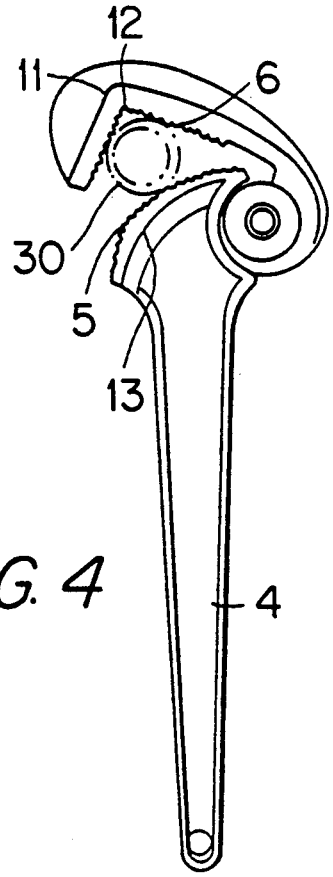
FIG. 4 illustrates the using state of the pipe wrench according to the present invention.
Figure 5:
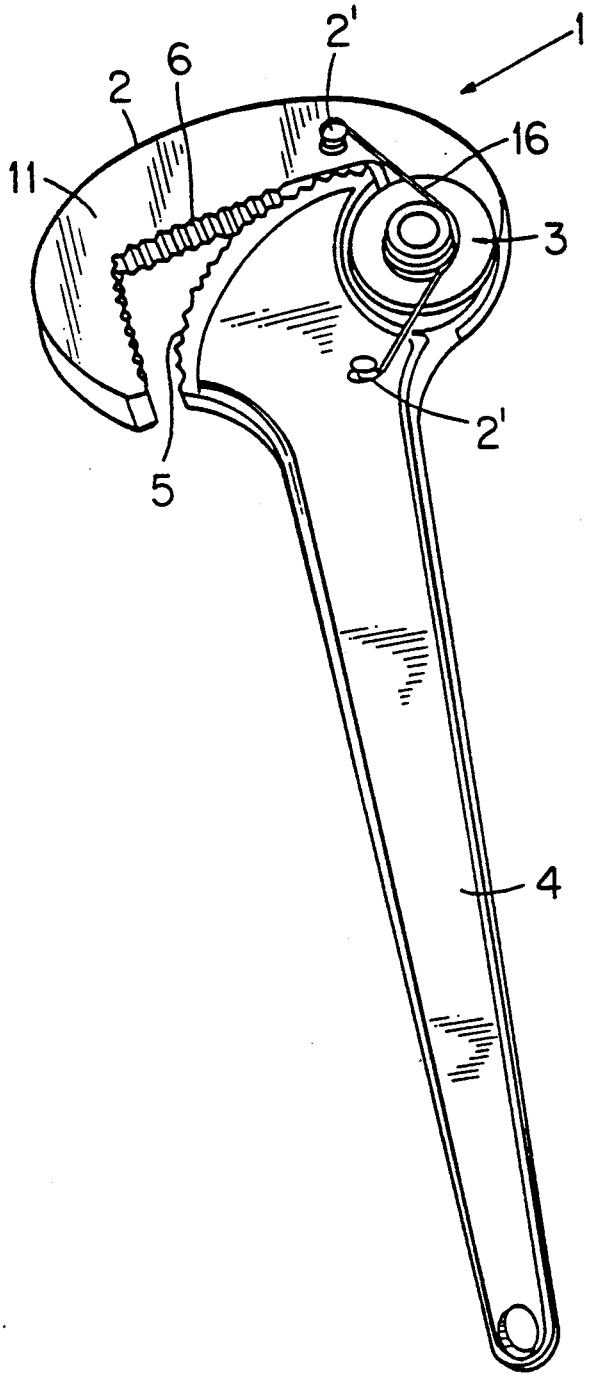
FIG. 5 is a perspective view showing a second embodiment of the pipe wrench according to the present invention.
Figure 6:
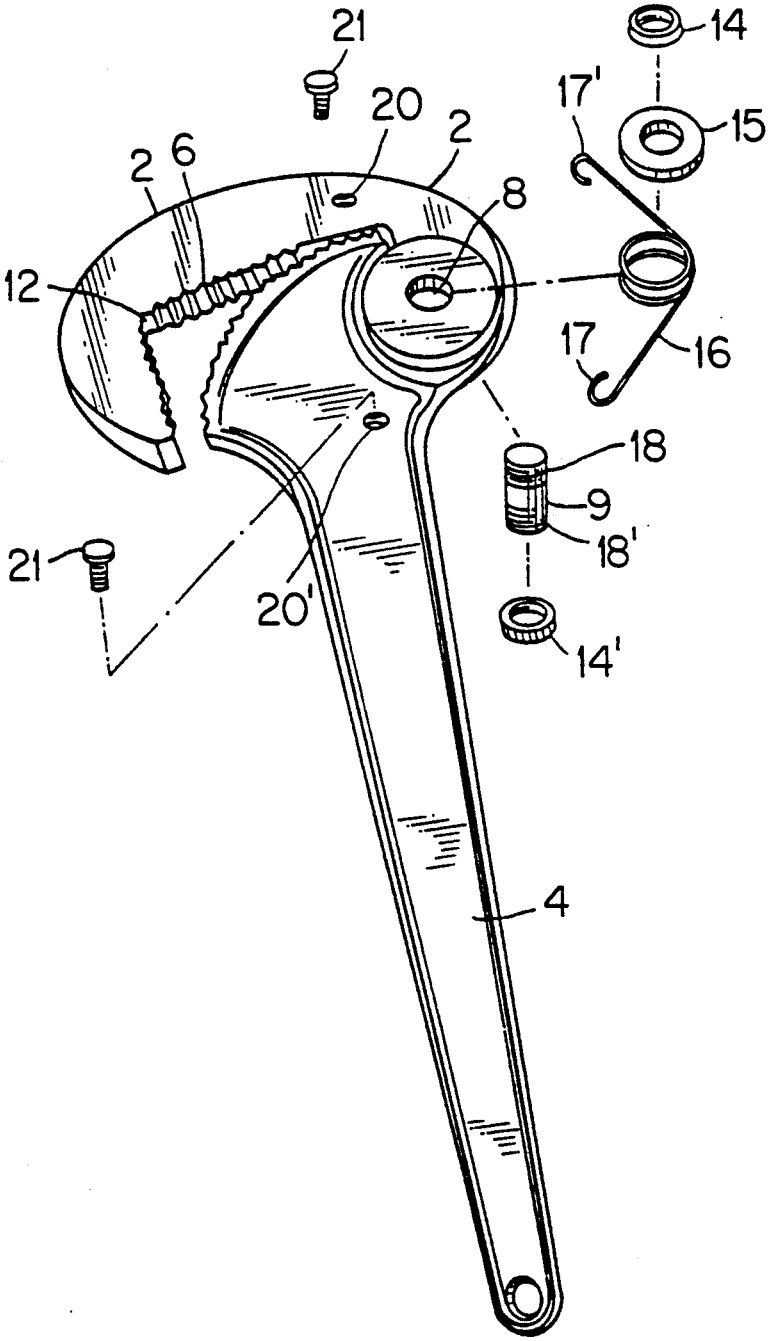
FIG. 6 is an exploded perspective view showing the second embodiment of the pipe wrench according to the present invention.
Figure 7:
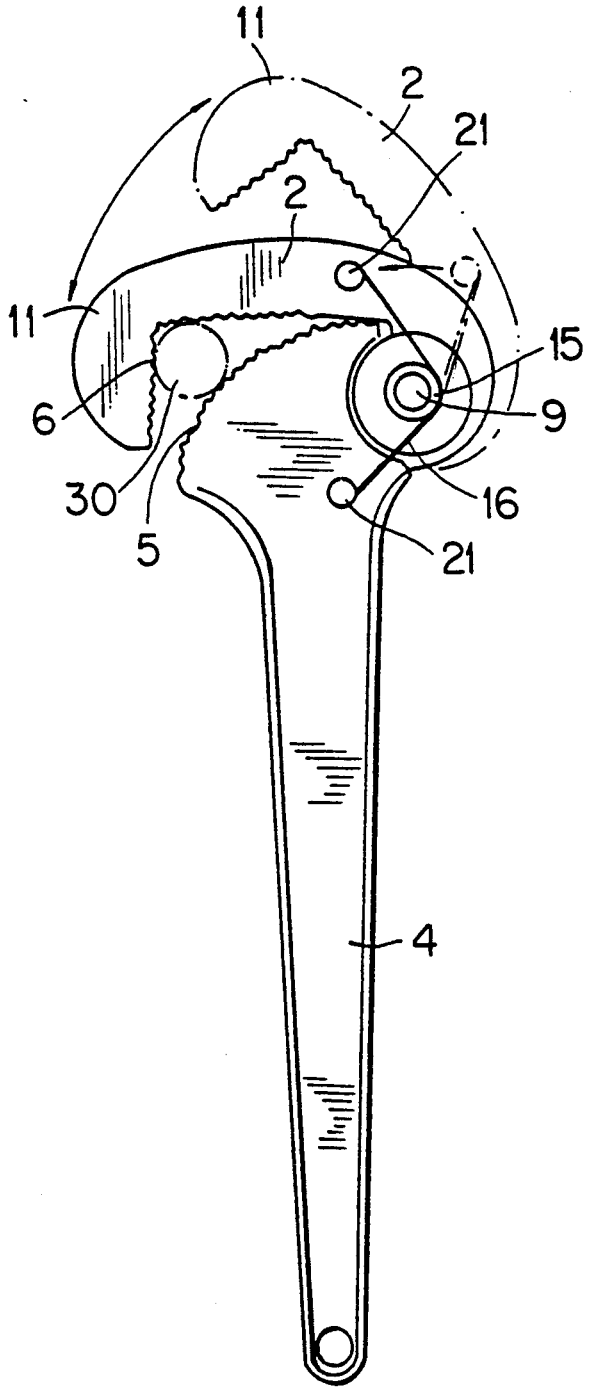
FIG. 7 illustrates the actuation of the second embodiment of the pipe wrench according to the present invention.
Figure 8:
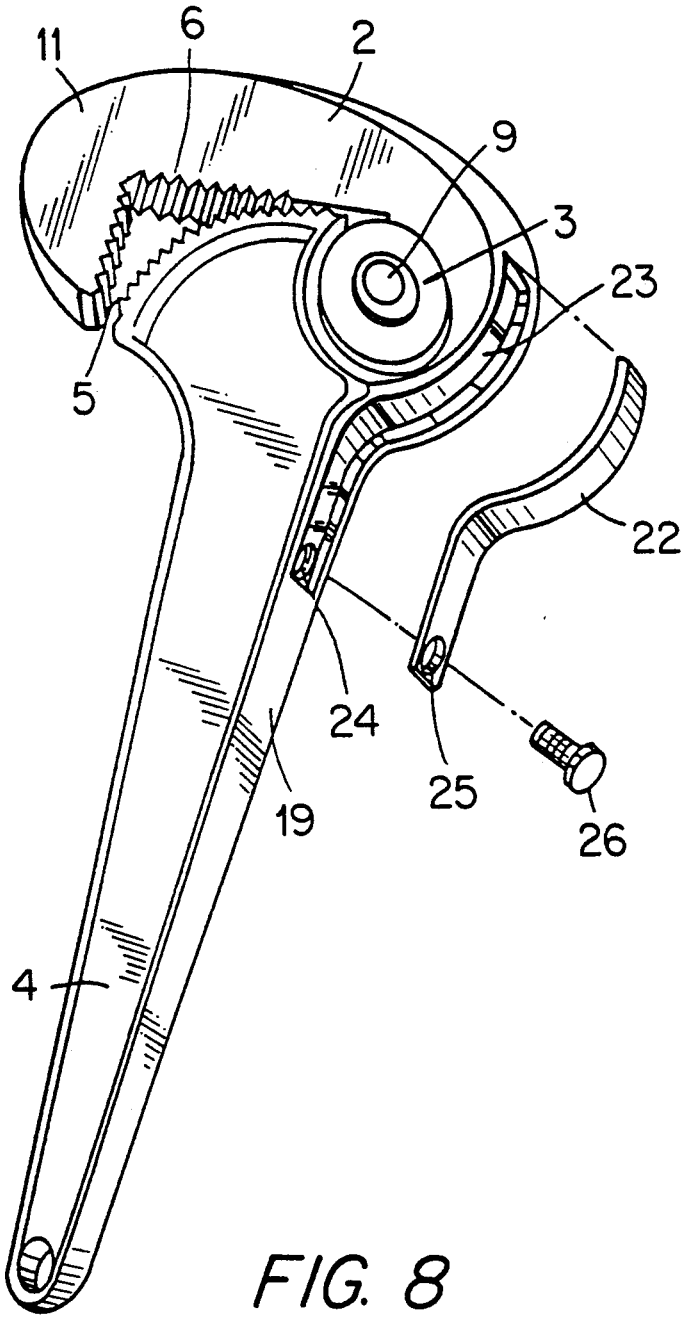
FIG. 8 is an exploded perspective view showing a third embodiment of the pipe wrench according to the present invention.

Reference code 1 indicates the pipe wrench according to the present invention, and, as shown in the drawings, the pipe wrench according to the present invention includes a pivotable portion 2 capable of pivoting around a shaft 9 and a handle portion 4. The inside of the pivotable portion 2 is provided with a right angled corner 12 and teeth portions 6 formed to the left and right of the corner 12. A bent portion 11 forms a part of the pivotable portion, and covers the corner 12 and a part of the teeth portions 6. A hinge portion 3 is formed integrally with the pivotable portion 2 on the one hand, and integrally with the handle portion 4 on the other hand, and includes a disc shaped space 7 formed between two disc shaped plates, and shaft holes 8 formed at the centers of the disc shaped plates. The handle portion 4 includes a teeth portion 5 formed on the arcuate edge of a curved portion 13, a disc shaped plate 10 to be inserted into the disc shaped space 7, and a shaft hole 8' formed at the center of the disc shaped plate 10. The disc shaped plate 10 is inserted into the disc shaped space 7, and the shaft 9 is inserted into the shaft holes 8 and 8', thereby forming the hinge portion 3.

The second embodiment of the present invention is constituted as described below. Bolt holes 20 and 20' are formed on the pivotable portion 2 and the handle portion 4 respectively, and thread portions 18 and 18' are formed on the opposite end portions of the shaft 9. The threaded shaft 9 is inserted into the shaft holes 8 and 8', and a spring 16 having hooked arms 17 and 17' is installed onto the shaft 9, while the shaft 9 is fastened by means of nuts 14 and 14' after interposing a washer 15. The hooked arms 17 and 17' are respectively secured to bolts 21 and 21' which are threadably fitted into the bolt holes 20 and 20', thereby forming a hinge portion 3.

The third embodiment of the present invention is constituted as described below. That is, on sides of the pivotable portion 2 and the handle portion 4, there are formed grooves 23 in an aligned form, while a bolt hole 24 is formed on the bottom of the groove 23 of the handle portion 4. A leaf spring 22 having a bolt inserting hole 25 is fitted into the groove 23, and then, the leaf spring 22 is fastened by means of a bolt 26 within the groove 23, so that the pivotable portion 2 should be pushed to the curved portion 13 of the handle portion 4.

Figure 9:
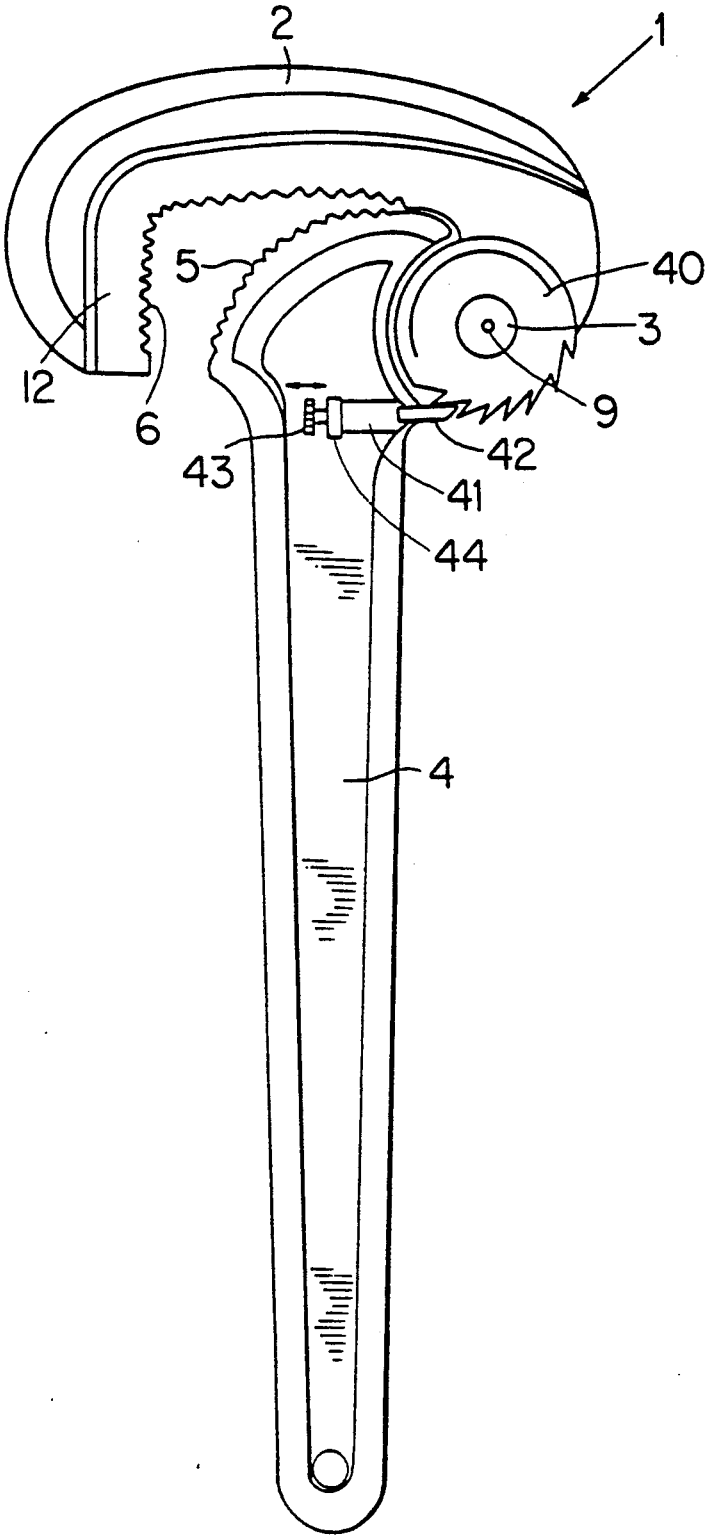
FIG. 9 is a perspective view of a fourth embodiment of the pipe wrench of the present invention.
Figure 10:
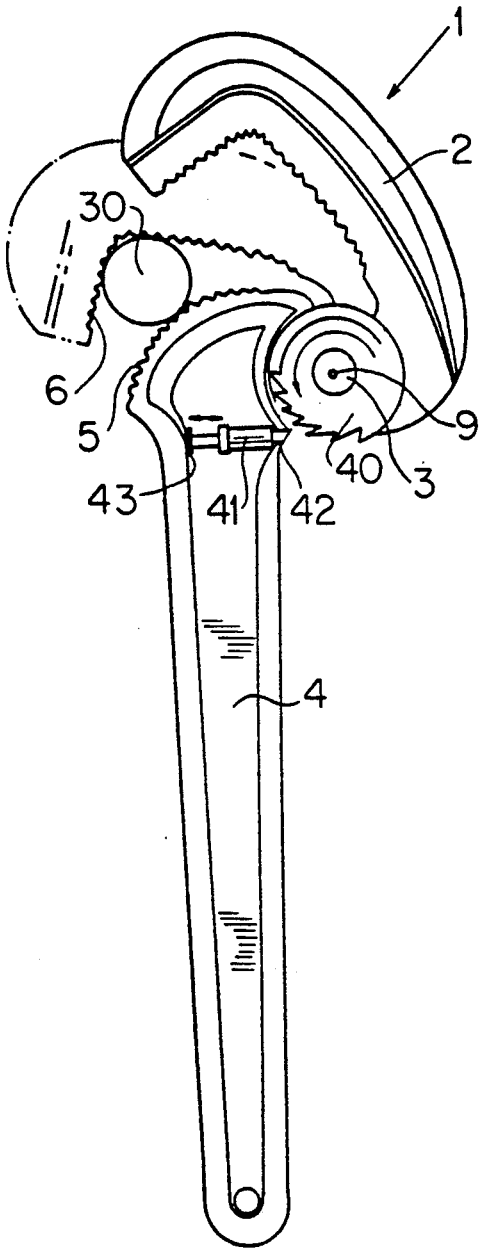
FIG. 10 illustrates the actuation of the fourth embodiment of the present invention.
Figure 11:
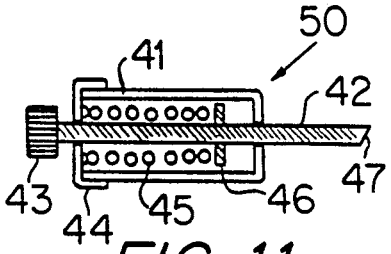
FIG. 11 is a sectional view showing the critical portions of the fourth embodiment of the present invention.

FIG. 9 illustrates a fourth embodiment of the pipe wrench of the present invention. Referring to this drawing, a ratchet gear 40 is provided on the end portion of the pivotable portion 2, and an engaging key 42 is projected from below the teeth portion 5 of the handle portion 4 and facing to the ratchet gear 40, thereby forming braking portion 50. The end of the engaging key 42 of the braking portion 50 forms an inclined face 47 which is inclined at an angle same as the inclination angle of the teeth of the ratchet gear 40. An engaging portion 46 includes the engaging key 42, a handle 43, a box 41, a spring 45, and a cap 44. The handle 43 is formed at an end of the engaging key 42, opposite to the inclined face 47, and the spring 45 is elastically installed within the box 41 by means of the cap 44, so that the engaging key 42 should be able to contact and depart to and from the ratchet gear 40.

The pipe wrench of the present invention constituted as above will now be described as to its operation and effects.

First, the pivotable portion 2 is widely spread, and a pipe or rod 30 to be turned is put to the teeth portion 5 of the curved portion 13 of the handle portion 4. Then the pivotable portion 2 is closed, so that the pipe or rod 30 should be subjected to a pressing force between the teeth potions 5 and 6 by hand or the spring, and that the pipe or rod 30 should be securely disposed on the rectangular corner 12. Therefore, if the handle portion 4 is turned, the pipe or rod 30 is turned accordingly.

Meanwhile, in the fourth embodiment of the present invention, the pivotable portion 2 is widely opened, the pipe or rod 30 that is to be turned is put on the teeth portion 5 of the curved portion 13, and then, the pivotable portion 2 is closed. In this state, the inclined face 47 of the engaging key 42 of the braking portion 50 is engaged with the teeth of the ratchet gear 40, and the teeth portions 5 and 6 are closely contacted with the surface of the pipe or rod 30, so that the pivotable portion 2 can not be pivoted.

According to the present invention as described above, the constitution is simple and the manufacturing is easy.

Further, if the pipe to be turned is put to the curved portion 13 of the handle portion 4 after opening the pivotable portion 2, and then, if the pivotable portion 2 is closed, the pipe or rod is naturally secured to the corner 12 and between the teeth portions 5 and 6.

Therefore the pipe or rod can be turned without slippage, and working time can be saved.

What is claimed is:

1. A pipe wrench, comprising:

a handle including an upper portion having a plurality of teeth and a disc shaped plate having a central bore;

a pivotable member including a surface having a plurality of teeth and a right-angled corner;

a ratchet gear integrally formed on the pivotable member, the rachet gear including a central bore;

means, disposed within the central bore of the rachet gear and the central bore of the handle, for joining the pivotable member to the upper portion of the handle so that the plurality of teeth on the pivotable member are opposed to the plurality of teeth on the upper portion of the handle;

an engaging member having two ends, one end having an inclined surface which engages the rachet gear, and the second end including a handle;

a housing supporting the engaging member on the upper portion of the handle; and a spring disposed within the housing, the spring urging the inclined surface of the engaging member into contact with the rachet gear.

* * * * *